United States Patent [19]

Lightbody

[11] 3,965,486

[45] June 29, 1976

[54] PNEUMATIC KNEE PAD

[76] Inventor: Charles S. Lightbody, 125 W. Third St., Duluth, Minn. 55802

[22] Filed: Feb. 5, 1975

[21] Appl. No.: 547,209

[52] U.S. Cl. ..... 2/24; 128/165

[51] Int. Cl.[2] ..... A41D 13/06

[58] Field of Search ..... 2/2, 16, 22, 24, 62; 54/82; 128/133, 89 R, 87 R, 165

[56] References Cited

UNITED STATES PATENTS

| | | | |
|---|---|---|---|
| 871,760 | 11/1907 | Long | 2/24 |
| 876,237 | 1/1908 | Ridlon | 2/2 |
| 1,117,168 | 11/1914 | Crowley | 2/24 |
| 1,721,739 | 7/1929 | Kennedy | 2/2 |
| 3,193,984 | 7/1965 | Schubert | 128/165 X |
| 3,194,233 | 7/1965 | Peckham | 128/165 X |
| 3,551,912 | 1/1971 | Viglione | 2/24 |
| 3,784,985 | 1/1974 | Conroy | 2/22 |

FOREIGN PATENTS OR APPLICATIONS

| | | | |
|---|---|---|---|
| 1,903,217 | 4/1970 | Germany | 128/89 |

*Primary Examiner*—Werner H. Schroeder
*Assistant Examiner*—Moshe I. Cohen
*Attorney, Agent, or Firm*—Wicks & Nemer

[57] ABSTRACT

A pneumatic knee pad which includes a main hollow inflatable flexible body portion divided into a first and a second chamber. Each of said chambers has mounted thereon and communicating internally therewith a multiplicity of flexible spaced hollow fingers disposed at right angles to the main body portion together with buckle-equipped straps connected to the main body portion for connecting the pad to a knee of a user.

1 Claim, 5 Drawing Figures

PNEUMATIC KNEE PAD

SUMMARY

The invention relates to an improvement in knee pads and more particularly to a pneumatic knee pad. It is an object of the invention to provide a knee pad which conforms to and supports the knee. It is also an object of the invention to provide a knee pad which has two chambers and communicating with each are a multiplicity of spaced hollow fingers on the sides of the pad, each chamber and its fingers being inflatable. With the present invention with the knee bent, the air in one or both of the chambers is forced into one or more of the fingers which tighten against the knee. As a result the bones do not separate in the socket which may cause torn ligaments, tendons, cartilage, etc. Further, the pad conforms to any abnormality in the configuration of the knee and protects the knee from external blows.

In the drawings, forming part of this application:

Figure 1:
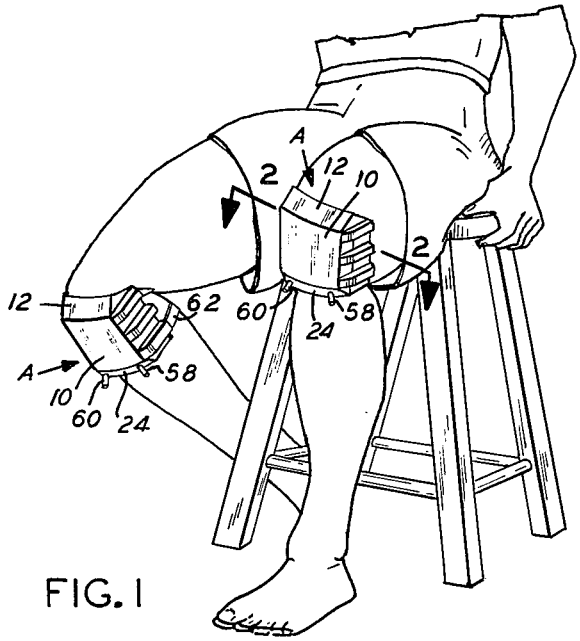
FIG. 1 is a perpective view of a pair of pnuematic knee pads shown in operative position on the knees of a user and embodying the invention.

Referring to the drawings in detail, the pneumatic knee pad A includes a main body portion 8 including the flexible front wall 10. The front wall 10 terminates in the flexible top wall 12 which in turn terminates in the flexible rear wall 14 spaced from the front wall. The rear wall 14 is bonded by adhesive or the like to a fabric support member 16 which includes the front wall portion 18 which terminates at one edge in the first side wall portion 20. The other edge of the portion 18 terminates in the second side wall portion 22.

The lower edges of the front wall 10 and the rear wall are connected to the bottom wall 24. The outer edges of the front and rear walls 10 and 14, respectively, are connected to the side walls 26 and 28. The numeral 30 designates a central internal wall extending the length of and connected to the front and rear walls 10 and 14, respectively, and also the top and bottom walls 12 and 24, respectively, thereby providing first and second chambers C and Ca, chamber C formed between internal wall 30, side wall 26, top wall 12, bottom wall 24 and front and rear walls 10 and 14, respectively. Chamber Ca is formed and bounded by internal wall 30, side wall 28, top wall 12, bottom wall 24 and front and rear walls 10 and 14.

Mounted on the sidewall portion 22 of the support member 18 are the spaced hollow fingers 32, 34, and 36 each having a top wall 38, a bottom wall 40, an outer side wall portion 42, an inner side wall 44 and a rear end wall 46. The outer side wall 42 curves inwardly at its front end to and is connected with the support portion 22 at the front wall 10. The outer end of each inner side wall 44 of each finger 32, 34, and 36 is formed with an air transfer hole 48 which allows communication of each of the hollow fingers with chamber Ca.

The sidewall portion 20 of the support 18 is formed with fingers 50, 52, and 54 which are identical to fingers 32, 34, and 36 and the inner wall of each finger if formed with a hole 56 which allows communication of each fingers 50, 52, and 54 with chamber C. The various wall portions may be made of rubber or flexible plastic and bonded to the support member 16 by adhesive or in a molding process. The bottom wall 24 has mounted thereon the first conventional air inflation valve 58 which allows inflation of the chamber Ca and fingers 32, 34, and 36 via communication holes 48. A second conventional air inflation valve 60 is mounted on the bottom wall 24 which allows inflation of the chamber C and fingers 50, 52, and 54 via communication holes 56.

Figure 2:
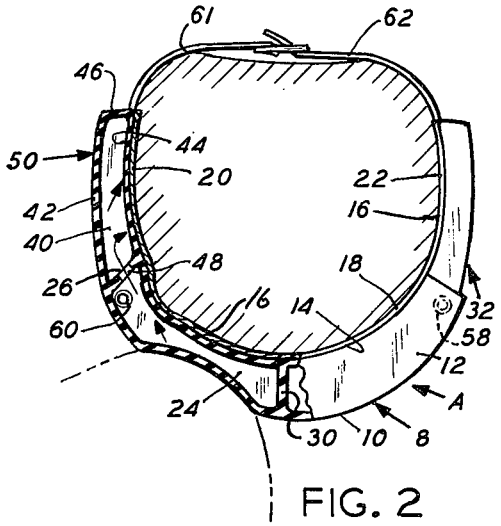
FIG. 2 is a sectional view of the line 2—2 of FIG. 1 with a portion of the pad shown as conforming to the knee.
Figure 3:
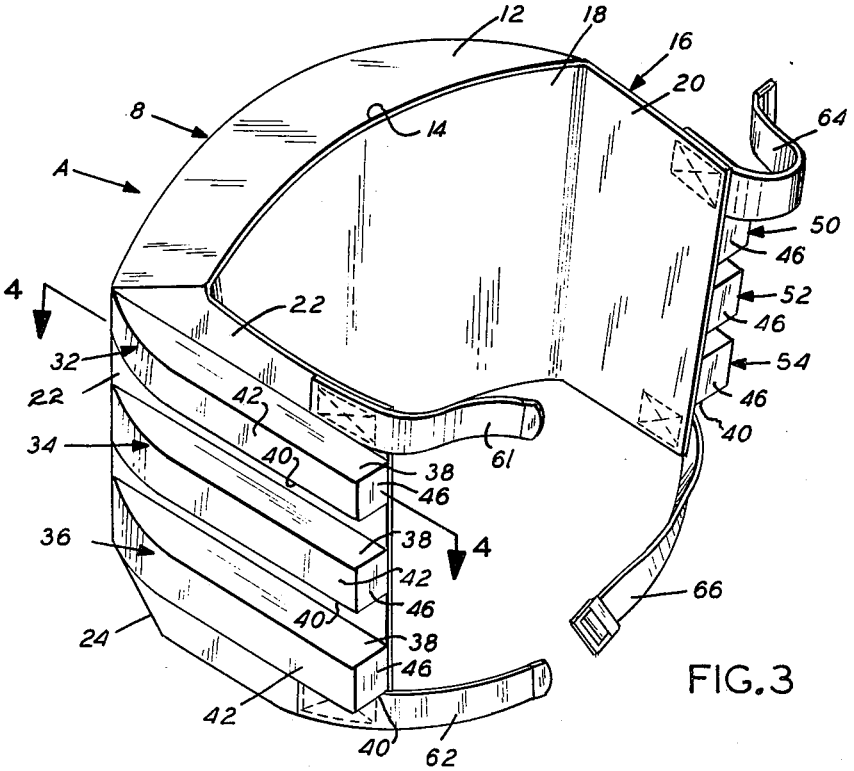
FIG. 3 is a perspective view of the knee pad from the rear thereof.
Figure 4:
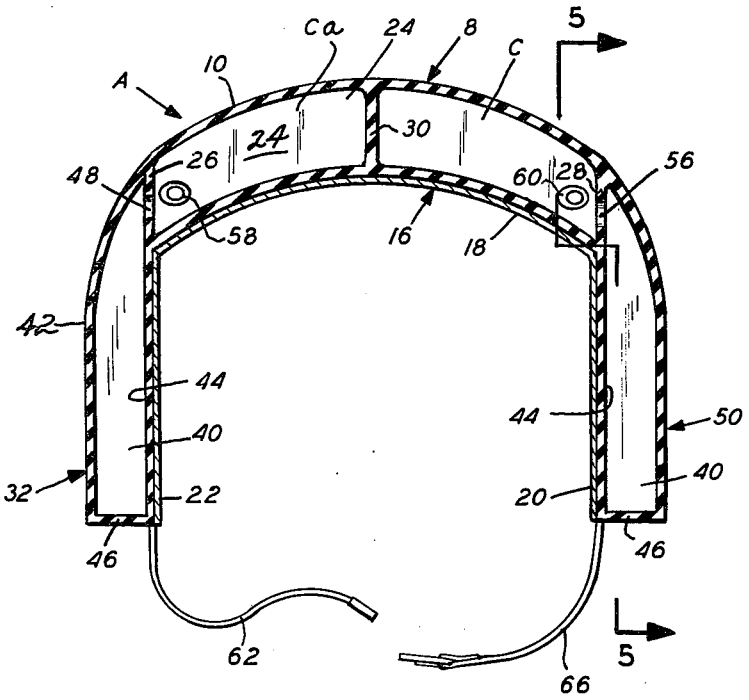
FIG. 4 is a sectional view on the line 4—4 of FIG. 3.
Figure 5:
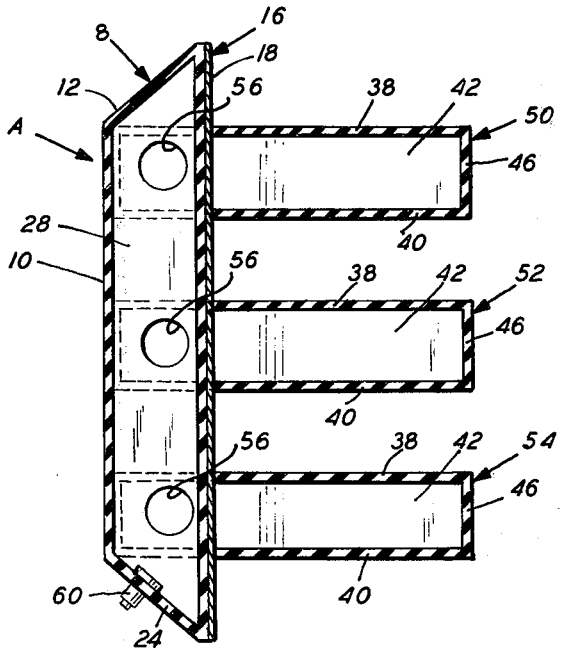
FIG. 5 is a sectional view on the line 5—5 of FIG. 4.

Further provided is an upper free ended strap half 61 connected at one end to the support sidewall portion 22 and a lower free ended strap half 62 connected at one end to the portion 22. Complementary buckle-equipped upper and lower half straps 64 and 66, respectively, are provided which are engageable about a knee to mount the knee pad on the knee, particularly as illustrated in FIGS. 1 and 2.

OPERATION

In using the knee pad A, the chambers C and Ca and the fingers connected therewith are inflated by means of the valves 58 and 60. The pad is then strapped on the knee as illustrated in the Figures. With the two chambers C and Ca there is provided a substantially equal flow of air from a chamber into the hollow fingers. The knee pad in effect is compressed on the knee and holds it together as it were. When the knee is bent the air in the chambers C and Ca is forced into the finger members on the sides of the pad which in turn tightens against the knee so that the bones of the knee do not become separated in the socket which can cause torn ligaments, tendons, cartilage and the like. The fingers are so located that when the pad is in place upon the knee, the top fingers are located just above the joint, the middle fingers across the ball and socket and the lower fingers located just below the joint.

The hollow chambers C and Ca together with the hollow fingers absorb external blows and the transfer of air from chambers to fingers and vice versa allows the pad to conform to a knee.

I claim:

1. A pneumatic knee pad comprising:

a. a main hollow body portion including spaced side walls connected to b. a front wall and c. a rear wall spaced from said front wall, d. a top wall connected to said side walls and said front and rear walls and e. a bottom wall connected to side walls and said front and rear walls, f. a central wall connected internally of said front and rear walls and said top and bottom walls dividing said hollow body into first and second chambers, g. a plurality of spaced hollow fingers extending at substantially right angles from and communicating with the first chamber, h. a plurality of hollow fingers extending at substantially right angles from and communicating with the second chamber, i. means for attaching the pad to the knee of a user, and j. means for inflating each of said first and second chambers with air which also inflates said communicating fingers, the air in the chambers is being forced into the fingers when the chamber is deformed to hold the knee joint parts together.

* * * * *